United States Patent [19]

Muhammad

[11] Patent Number: 4,953,869

[45] Date of Patent: Sep. 4, 1990

[54] LEARNING GAME

[76] Inventor: Annie Muhammad, 168 Frank St., New Haven, Conn. 06519

[21] Appl. No.: 401,234

[22] Filed: Aug. 31, 1989

[51] Int. Cl.[5] ..... A63F 3/06; A63F 9/18

[52] U.S. Cl. ..... 273/236; 273/269; 273/141 R

[58] Field of Search ..... 273/269, 141 R, 236, 273/272

[56] References Cited

U.S. PATENT DOCUMENTS

| | | | |
|---|---|---|---|
| 3,464,124 | 9/1969 | Lynd | 273/269 |
| 3,545,101 | 12/1970 | Fike | 273/269 |
| 3,734,508 | 5/1973 | Snyder | 273/141 R |
| 4,306,724 | 12/1981 | Brzezinski | 273/272 |
| 4,344,627 | 8/1982 | Jones et al. | 273/273 |
| 4,568,086 | 2/1986 | Krogh | 273/141 R |
| 4,606,546 | 8/1986 | Rita | 273/269 |
| 4,607,848 | 8/1986 | Maguire et al. | 273/269 |

FOREIGN PATENT DOCUMENTS

| | | | |
|---|---|---|---|
| 451954 | 10/1948 | Canada | 273/269 |

OTHER PUBLICATIONS

Spin Bingo Set, Sunset House Catalog, Sep. 1, 1973.

*Primary Examiner*—Benjamin Layno
*Attorney, Agent, or Firm*—CTC & Associates

[57] ABSTRACT

A learning game for a particular factual subject includes a spin wheel having a face bearing question-asking designators apporpriate to the subject. The game also includes a plurality of identical boards, one for each player. Each board bears correct answer designators corresponding to all of the question-asking designators of the spin wheel. Each display also bears at least one designator which is not the answer to any question-asking designator. The players first spin the spin wheel to randomly select a question, board markers are used to cover the corresponding correct answer designators on the board. The spin wheel also includes a non-question-asking designator which gives the player spinning the same the opportunity to freely place a marker on any board designator preferably a designator which is not the answer to any question-asking designator. The game continues until a player has covered all the correct answer designators on his or her board.

5 Claims, 3 Drawing Sheets

NATIONAL LEAGUE TEAMS

| CITY | NICKNAME |
|---|---|
| ATLANTA | BRAVES |
| CHICAGO | CUBS |
| CINCINNATI | REDS |
| HOUSTON | ASTROS |
| LOS ANGELES | DODGERS |
| MONTREAL | EXPOS |
| NEW YORK | METS |
| PHILADELPHIA | PHILLIES |
| PITTSBURGH | PIRATES |
| SAN DIEGO | PADRES |
| SAINT LOUIS | CARDINALS |
| SAN FRANCISCO | GIANTS |

88

90

LEARNING GAME

BACKGROUND OF THE INVENTION

This invention relates to a learning or educational game, the idea being to make learning fun.

Any number of subjects are possible and a plurality of subjects can be packaged together, usually according to age groups. Examples of subjects include the alphabet (English and foreign), state capitals, sports (team cities and nicknames), mathematics, chemistry, farm animals, wild animals, grammar, psychology terms, sociology terms, signs of nature (rain, sun, moon, etc.), parts of the body, birds, presidents, flowers, colors, rivers, seas and oceans, fish, trucks and cars, history, science (such as chemical elements), and astronomy. The foregoing list is by way of example only and is not to be taken as limiting in any sense.

Lynd U.S. Pat. No. 3,464,124 issued Sept. 2, 1969 discloses a teaching device having a board with different content for each player. The device is based on phonograms.

Fike U.S. Pat. No. 3,545,101 issued Dec. 8, 1970 relates to an educational board game in which the students are given identical boards, which may relate to arithmetic or geography or whatever. An instructor calls out problems and each student marks down the answers on his game board until a complete row or column is filled. No spin wheel or checkers are involved.

Jones et al. U.S. Pat. No. 4,344,627 issued Aug. 17, 1982 discloses an alphabet game comprising a rectangular gameboard which is commonly used by all players, a deck of cards and a set of chips. The gameboard has rows of spaces marked with numerals and the cards are printed alphabetically with words indicating the numerals, and each chip is printed with a letter which is the first letter of one of the words.

Rita U.S. Pat. No. 4,606,546 issued Aug. 19, 1986 discloses an educational game in which each player has an answer board having a series of answer sets, each with a plurality of answers. A plurality of cards are divided into a plurality of groups. Each card has a question on one side and an answer on the other. Each question has a location code directing the player to an answer set on the answer board. By answering the question correctly the player may cover a portion of a game board with a marker. When the game board is covered by a single player, that player is declared the winner. A die is used to determine from which group of cards a card will be chosen.

Maguire et al. U.S. Pat. No. 4,607,848 issued Aug. 26, 1986 relates to a word game played for amusement involving guessing concealed words through definitional and phonetic clues.

It is an important object of the present invention to provide a learning game based on a particular subject, which game will make the learning of that subject fun for participants for whom the game is designed.

It is another object of the invention to provide a learning game which will motivate both children and adults to learn on their own.

It is a further object of the invention to provide such a game which is simple and easily understood.

The foregoing and additional objects and advantages of the invention will become apparent hereinafter.

SUMMARY OF THE INVENTION

A spin wheel is provided with a face for a factual game subject, the face bearing deisgnators appropriate to the subject. For example, if the game subject is team nicknames, the face of the spin wheel would bear the names of either the team cities or the team nicknames and possibly some additional designators, such as "Lose Turn" or "Take Extra Turn" or "Free Placement", etc. A game board is also provided for each game subject. The board has a plurality (such as 2, 3 or 4) of identical displays, one for each player. The board is provided with designators which match those of the spin wheel face. A plurality of board markers or checkers is provided to each player. There are at least as many board markers for each player as the board has designators.

A booklet is also provided with correct answers to the game questions.

The idea, regardless of game subject, is that the first player to fill his or her game board with markers is the winner.

The manner in which the invention attains the foregoing objects and advantages will appear from the following description.

DESCRIPTION OF THE INVENTION

The game will be described with reference to a game of identifying the cities of National League baseball teams with their nicknames, it being understood that the game is typical of games on all subjects.

Figure 1:
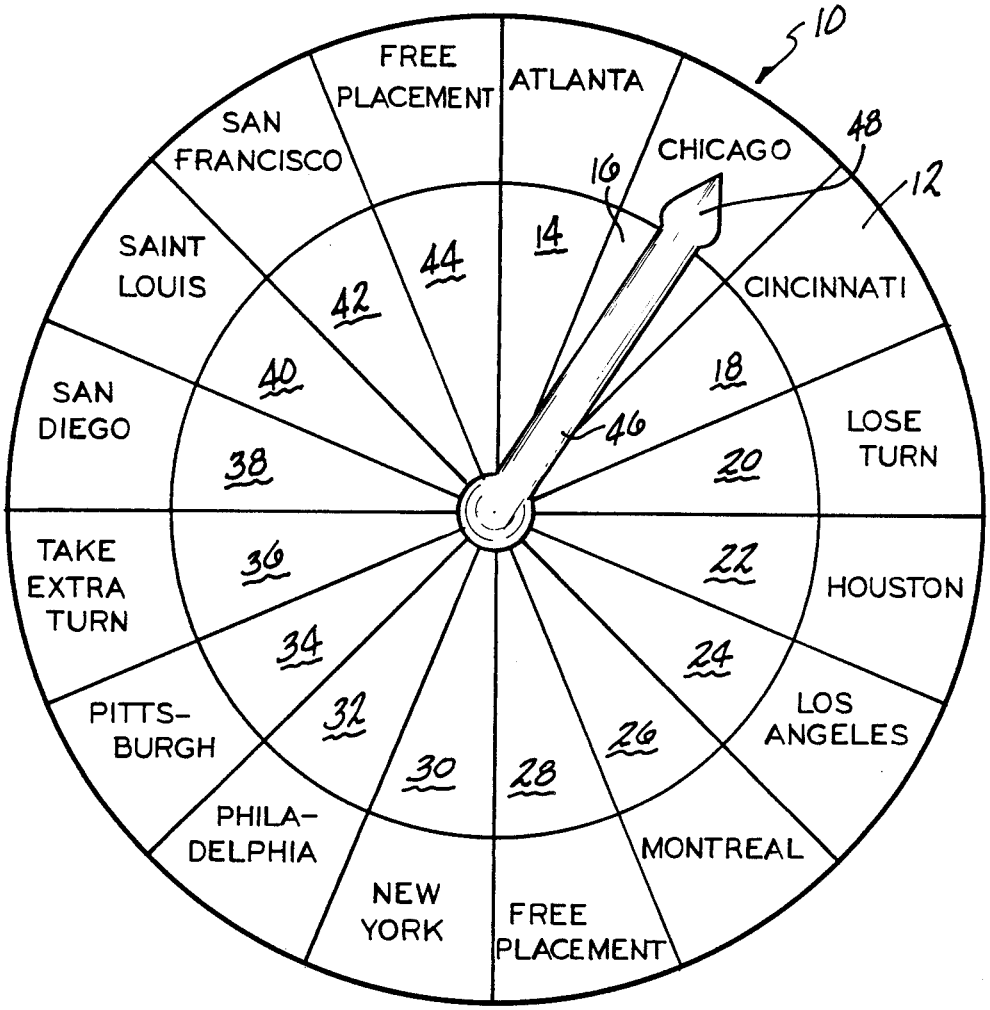
FIG. 1 is a plan view of the face of a spin wheel for playing a game of identifying the locations of National League baseball teams with their nicknames.

FIG. 1 shows in plan view a spin wheel 10 having a round face 12 divided into sixteen contiguous pie-shaped sectors each of which subtends an angle of 22.5 degrees, the sixteen sectors being denoted 14, 16, 18, 20, 22, 24, 26, 28, 30, 32, 34, 36, 38, 40, 42 and 44, the outer portions of which are marked with the designators Atlanta, Chicago, Cincinnati, Lose Turn, Houston, Los Angeles, Montreal, Free Placement, New York, Philadelphia, Pittsburgh, Take Extra Turn, San Diego, Saint Louis, San Francisco and Free Placement, respectively. It will be noted that twelve of these sixteen designators are the names of the twelve cities now represented in the National Baseball League. The other four designators are discussed below. Spin wheel 10 further includes a spinnable pointer 46 pivotally mounted at the center of face 12 and having an arrow 48 at the free end thereof, whereby pointer 46 can be spun and will come to rest with arrow 48 indicating any one of sectors 14, 16, 18, 20, 22, 24, 26, 28, 30, 32, 34, 36, 38, 40, 42 and 44.

Should pointer 46 come to res. with arrow 48 denoting any one of the twelve cities, it is understood that spin wheel 10 is to be taken as asking the question : What is the nickname of the National Baseball League team located in that city?

Figure 2:
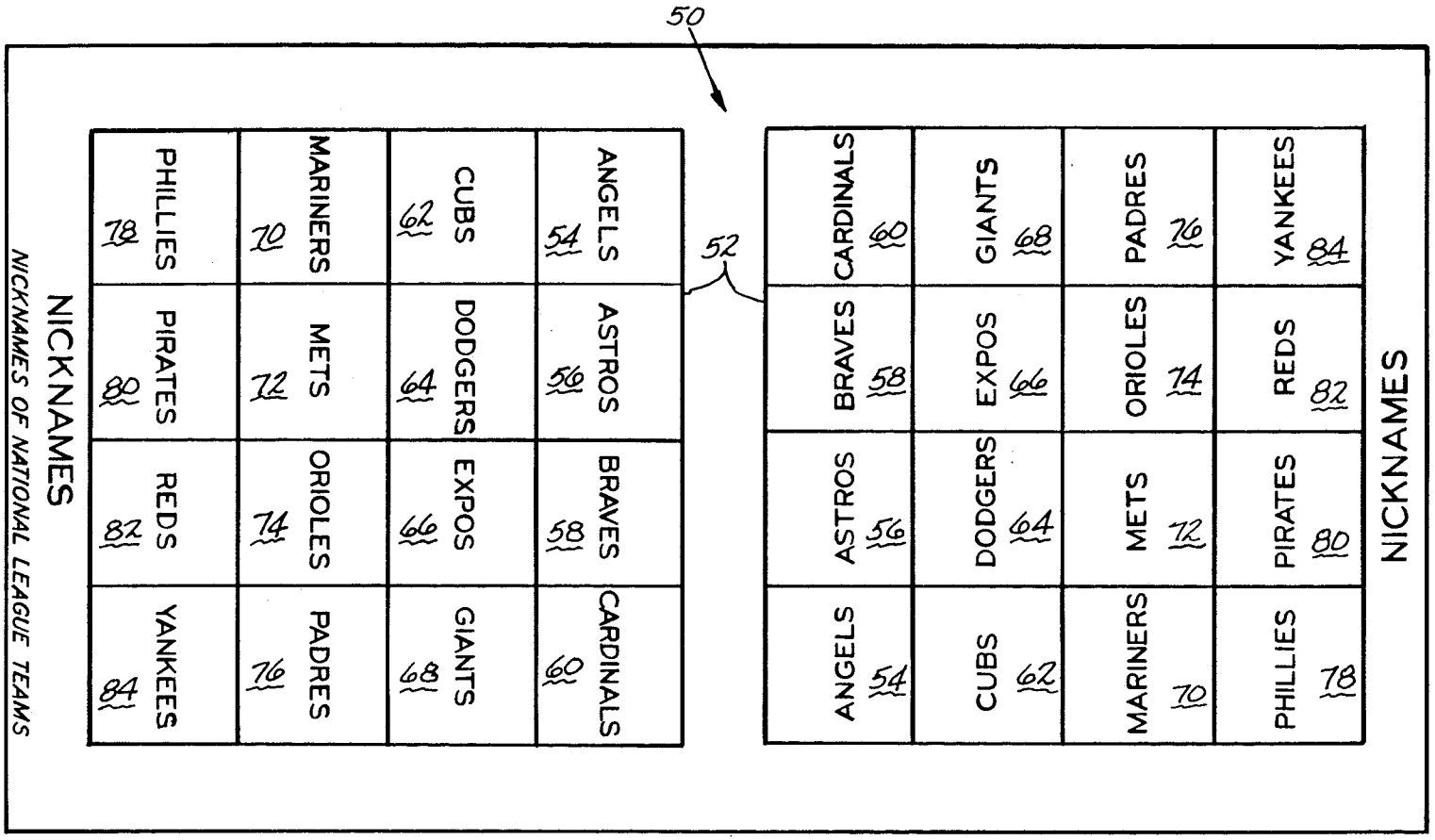
FIG. 2 is a plan view of a game board used in playing the game of FIG. 1.

FIG. 2 shows a game board 50 for use by two players with spin wheel 10 in playing the National League City-nickname game. Board 50 has two identical oppositelyfacing displays 52. Each display 52 comprises sixteen squares 54, 56, 58, 60, 62, 64, 66, 68, 70, 72, 74, 76, 78, 80, 82 and 84 bearing designators Angels, Astros, Braves, Cardinals, Cubs, Dodgers, Expos, Giants, Mariners, Mets, Orioles, Padres, Phillies, Pirates, Reds and Yankees, respectively, It will be noted that the designators of squares 54, 70, 74 and 84 are nicknames of American League teams, not National League teams. The designators of squares 56, 58, 60, 62, 64, 66, 68, 72, 76, 78, 80 and 82 are the nicknames of the twelve National League teams.

Figures 3, 4:
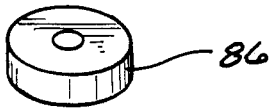
FIG. 3 is a perspective view of a board marker for playing any game.
FIG. 4 is a booklet opened up to give the correct answers to the game of FIG. 1.

FIG. 3 shows in perspective a round board marker 86 a plurality of which are needed to play the game being described. In fact, up to thirty-one markers 86 are needed for the two-player game being described. The diameter of marker 86 is less than the length of the side of each board square.

FIG. 4 shows an opened-up booklet 88 listing the National League cities and the nicknames of the teams therein. Booklet 88 is normally closed on fold line 90.

The winner of the game is the player who succeeds first in placing markers 86 on all the squares of his or her display 52 on game board 50.

The players may determine who goes first by spinning wheel 50. Each player spins until he or she spins the name of a city. The player spinning the city closest to the beginning of the alphabet goes first, and then spins for the first turn. In general, the players alternate turns. If a player spins spin pointer 46 and arrow 48 comes to rest on a city, the game is interpreted as asking that player the question: What is the nickname of the National League team from that city? For example, if the player spins "Chicago", the correct answer is "Cubs". The player spinning Chicago then has the opportunity of placing a marker 86 on a square of his or her display 52. Marker 86 should be placed on square 62. Regardless of where the player places marker 86, the other player can either make a challenge or not. If no challenge is made, the placement stands and the other player takes his or her turn. If a challenge is made and the placement is correct, the challenger loses a turn. If a challenge is made and the placement is incorrect, marker 86 is removed and the player making the erroneous placement loses a turn. Booklet 88 may be consulted, either by the players or preferably by a non-player, to resolve challenges.

If a player spins pointer 46 and arrow 48 comes to rest on any sector other than a city, i.e., any of sectors 20, 28, 36 or 44, the result is indicated. "Lose Turn" sector 20 means that the other player takes two turns in a row. "Take Extra Turn" sector 36 means that the player having spun sector 36 immediately takes another turn. "Free Placement" sector 28 or "Free Placement" sector 44 gives the player the opportunity to place a marker 86 on any unoccupied square on his or her display 52. Note that this is the only legitimate way to place a marker on square 54, square 70, square 74 or square 84, since "Angels", "Mariners", "Orioles" and "Yankees" are not nicknames for National League teams.

The game continues as described above until one of the players has a marker 86 on each of his or her squares 54, 56, 58, 60, 62, 64, 66, 68, 70, 72, 74, 76, 78, 80, 82 and 84.

Games of other subjects are similarly structured and played, and games of a plurality of subjects can be packaged together.

It is evident that the invention attains the above stated objects and advantages and others.

The disclosed details are not to be taken as limitations on the invention except as those details are included in the appended claims.

What is claimed is:

1. A learning game for a particular factual subject, said game comprising a spin wheel bearing spin wheel designators including question-asking designators appropriate to the subject, a plurality of markers and a related game board including a plurality of identical displays, one for each player, each said display having thereon designators among which are designators providing correct answers to all said question-asking designators, and said display also having thereon a designator which gives an answer to some question relating to the subject but which is not the correct answer to any question posed by said question-asking designators, said display designators to be covered by markers as the game is played, and said spin wheel designators including a non-question asking designator giving a player spinning the same the opportunity to place a marker on any board designator.

2. The game according to claim 1 further comprising correct answers to all said questions.

3. The game according to claim 1 wherein said spin wheel has a face which bears said spin wheel designators.

4. The game according to claim 1 wherein said designators further include a designator which results when spun in an extra turn for a player spinning the same.

5. The game according to claim 1 wherein said spin wheel designators include a designator which results when spun in loss of a turn for a player spinning the same.

* * * * *